United States Patent [19]

Rand, Jr.

[11] 4,105,010

[45] * Aug. 8, 1978

[54] FUEL SAVING APPARATUS FOR MULTIPLE CYLINDER INTERNAL COMBUSTION ENGINES

[76] Inventor: Earl W. Rand, Jr., 2101 Washington, Kansas City, Mo. 64108

[ * ] Notice: The portion of the term of this patent subsequent to Apr. 19, 1994, has been disclaimed.

[21] Appl. No.: 750,124

[22] Filed: Dec. 13, 1976

Related U.S. Application Data

[63] Continuation-in-part of Ser. No. 646,361, Jan. 2, 1976, Pat. No. 4,018,204.

[51] Int. Cl.[2] ..... F02D 9/00

[52] U.S. Cl. ..... 123/198 F; 123/124 R; 123/169 N

[58] Field of Search ..... 123/198 F, 198 R, 119 D, 123/124 R, 169 V

[56] References Cited

U.S. PATENT DOCUMENTS

| | | | |
|---|---|---|---|
| 1,812,709 | 6/1931 | Odee et al. | 123/169 V |
| 2,444,440 | 7/1948 | Grieshaber et al. | 123/198 F |
| 2,490,646 | 12/1949 | Murphy et al. | 123/169 V |
| 2,625,921 | 1/1953 | Van Ry | 123/169 V |
| 2,708,428 | 5/1955 | Fisher | 123/169 V |
| 3,204,139 | 8/1965 | Candelise | 123/169 V X |
| 3,400,702 | 9/1968 | Watkins | 123/198 F |

*Primary Examiner*—Charles J. Myhre
*Assistant Examiner*—Ira S. Lazarus
*Attorney, Agent, or Firm*—Fishburn, Gold & Litman

[57] ABSTRACT

A fuel saving apparatus for controlling the supply of fuel to one or more selected cylinders of a multi-cylinder internal combustion engine comprises a remotely and independently controlled fuel saving valve operably positioned to provide selective communication between the cylinder clearance volume and a reservoir volume disposed externally thereof. The valve is closed for normal, full power engine operation, and is opened for predetermined low engine power demand periods.- The opening of said valve so severely reduces cylinder intake vacuum and resultant air-fuel influx as to render temporarily ineffective the cylinder, thereby reducing engine fuel consumption.

10 Claims, 7 Drawing Figures

FUEL SAVING APPARATUS FOR MULTIPLE CYLINDER INTERNAL COMBUSTION ENGINES

This application is a continuation-in-part of pending United States patent application Ser. No. 646,361 filed Jan. 2, 1976, now U.S. Pat. No. 4,018,204.

This invention relates to multi-cylinder internal combustion engines and in particular to means for rendering temporarily ineffective selected cylinders during low engine power demand periods, thereby reducing engine fuel consumption.

The multi-cylinder internal combustion engine, such as the spark ignition piston engine commonly used in automobiles, is normally operated with fuel supplied to each of the several engine cylinders. Considerable economies can be realized however by split engine operation, such as operating an eight cylinder engine on four cylinders, under low and moderate load conditions. This economy is a result of the well known fact that individual cylinder efficiency is increased, up to an optimum point, when operating cylinder load is increased.

Split engine operation has long been recognized as a theoretically desirable goal. However, the general complexity of mechanisms which have been developed to achieve this type of operation have thus far precluded its commercial feasibility. The present invention relates to a greatly simplified split engine control system which is particularly efficient and reliable in operation.

The principal objects of the present invention are: to provide a fuel saving arrangement and valve member operably connected with at least one cylinder of a multiple cylinder internal combustion engine for breaking engine intake vacuum and air-fuel influx so as to render temporarily ineffective said one cylinder; to provide such an apparatus wherein a valve member is operably positioned to provide selective communication between the cylinder clearance volume and a reservoir volume disposed externally thereof; to provide such an arrangement wherein a closed manifold is connected with at least two of said valves for clean and efficient engine operation; to provide such an arrangement wherein a surge tank facilitates gas flow between the valves and further reduces air-fuel influx to those cylinders rendered ineffective; to provide such an arrangement wherein the fuel saving valve is open during both intake and compression cylinder strokes for smooth idling; to provide such an apparatus wherein power means remotely and independently operates said valve member; and to provide such an apparatus which is economical to manufacture, and particularly well adapted for the proposed use.

Other objects and advantages of this invention will become apparent from the following description taken in connection with the accompanying drawings wherein are set forth, by way of illustration and example, certain embodiments of this invention.

The drawings constitute a part of this specification and include exemplary embodiments of the present invention and illustrate various objects and features thereof.

Figure 3:
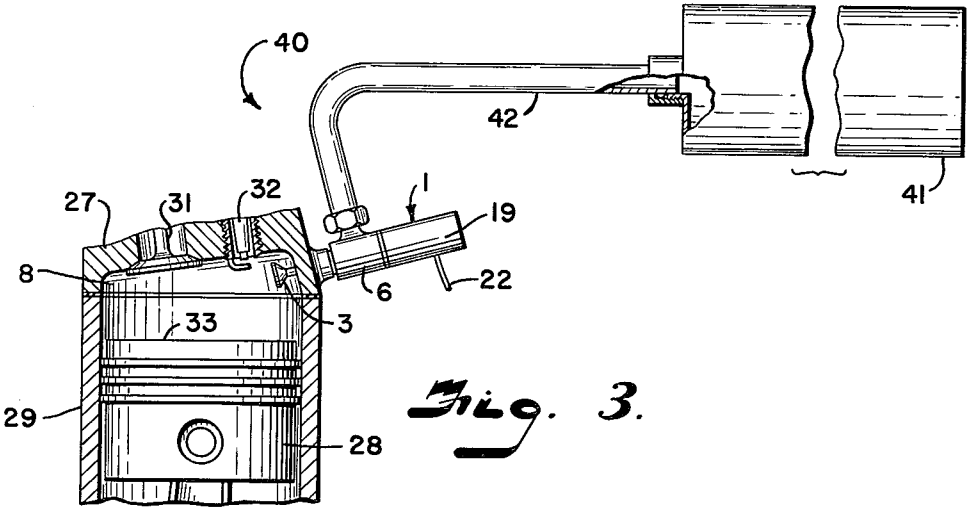
FIG. 3 is a partially schematic illustration of another embodiment of the present invention wherein the fuel saving valve communicates with a closed vessel.
Figure 1:
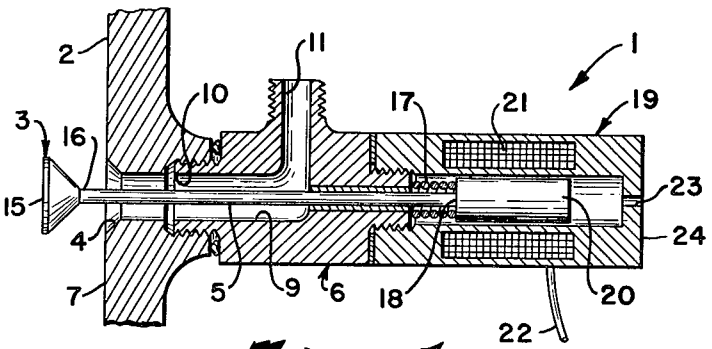
FIG. 1 is a partially schematic vertical cross-sectional view of a fuel saving valve embodying the present invention.

Referring more in detail to the drawings:

The reference numeral 1 generally designates a fuel saving apparatus for controlling the supply of fuel to one or more selected cylinders 2 of a multi-cylinder internal combustion engine. The apparatus 1 comprises a valve 3, a valve seat 4 mating therewith, a valve stem 5, resilient means normally urging the valve 3 and valve seat 4 into abutting, sealing contact, and a valve housing 6. The valve seat 4 is shown positioned in a wall portion 7 of the cylinder clearance volume 8, and communicates with a central, hollow portion 9 of the valve housing 6 through a first aperture 10. A second aperture 11 is disposed through the side wall of the valve housing 6 such that when the valve 3 is in a non-sealing position with the valve seat 4, there is communication between the inside and the outside of the clearance volume 8.

In the illustrated structure, the valve 3 and valve seat 4 have a frusto-conical shape with the larger, circular surface 15 thereof disposed inwardlymost of the cylinder wall portion 7 to assure the proper seating thereof during high cylinder pressures. The valve stem 5 has one end 16 thereof attached to the smaller surface of the valve, and extends outwardly therefrom. In this example, the valve 3 is resiliently retained in a normally closed position by a compressed coil spring 17 which surrounds a portion of the valve stem 5 and is attached at a point thereon adjacent to the outwardly disposed end 18 thereof. The valve 3 is automatically manipulated by means such as a vacuum, air pressure or hydraulic actuated cylinder (not shown), or the illustrated electric solenoid 19. In this example, the solenoid 19 is threadedly attached to the valve housing 6 and includes an armature 20 connected with the outward end 18 of the valve stem 5, and an electric winding or coil 21 which surrounds the armature. An electric current is supplied to the coil through wire 22 which activates the coil and forces the armature 20 and valve 3 forwardly, thereby opening the valve assembly. In this example, a vent aperture 23 is disposed through the end 24 of the solenoid to facilitate armature translation.

Figure 2:
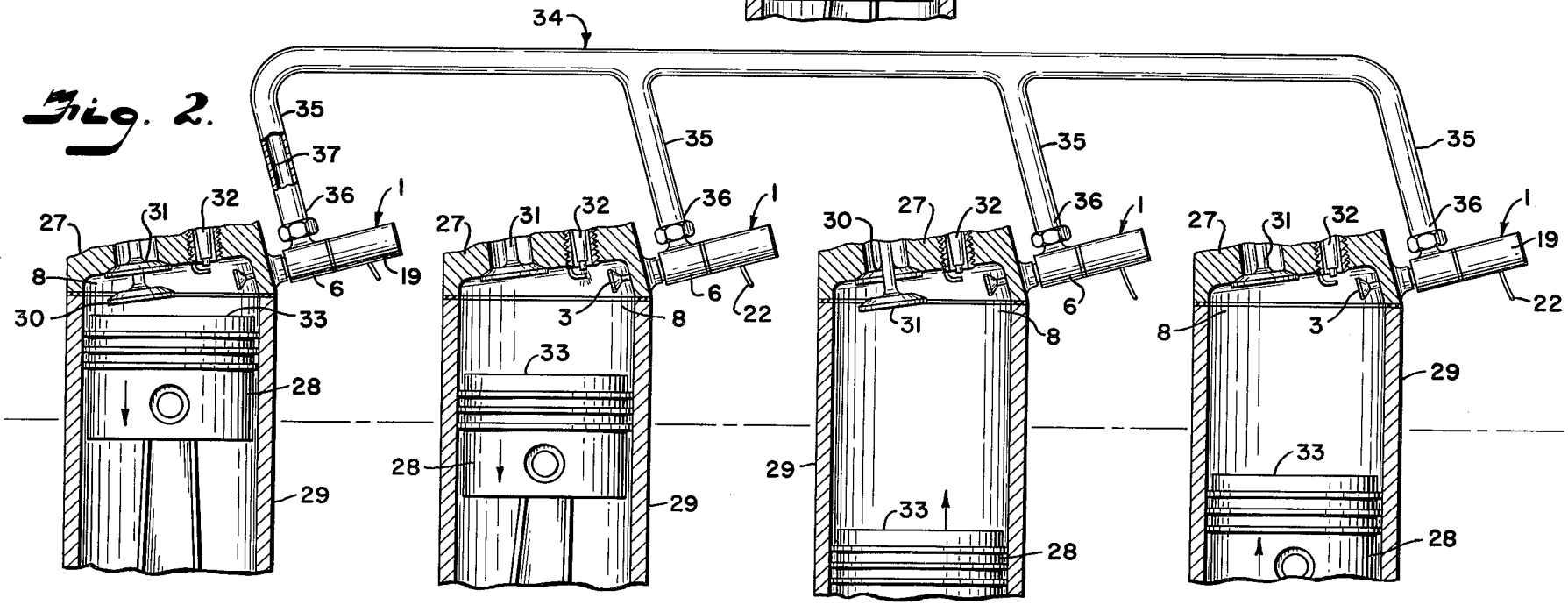
FIG. 2 is a partially schematic illustration of a fuel saving arrangement in the form of a multi-cylinder internal combustion engine for split operation, having an interconnected manifold.

The fuel saving valve assembly 1 is positioned in the head portion 27 of each of the selected cylinders of a multi-cylinder internal combustion engine for temporarily deactivating the same. In the embodiment illustrated in FIG. 2, four cylinders are shown each having a fuel saving valve assembly connected therewith. It is to be understood, however, that this invention contemplates the use of at least one fuel saving valve connected with one cylinder of a multi-cylinder internal combustion engine, and that more than one cylinder, including each cylinder, may be so equipped. In the event that each cylinder is provided with a valve assembly, only selected valves should be open at one time. As illustrated in FIG. 2, the multi-cylinder internal combustion engine includes a plurality of pistons 28 each being slidably mounted in a cylinder 29 and enclosed by the cylinder head 27 disposed above the piston. Each of the cylinders includes an intake valve 30, an exhaust valve 31, and a spark plug 32, all of which have a standard design. The valve assembly 1 is positioned through the clearance volume 8 of the cylinder, being defined as that volume of the cylinder above the upper surface 33 of the piston when the same is in a top dead-center position. When the valve 3 is in an open position, such as illustrated in FIG. 2, the cylinder clearance volume 8 communicates with a reservoir volume disposed externally thereof, such as the atmosphere, or in the illustrated structure, a closed manifold 34. It is to be understood that the present invention contemplates the use of any reservoir volume of gases, either closed or open, having a sufficient size to appreciably reduce cylinder intake vacuum to the extent that ignition in that cylinder is prevented. The manifold 34 includes a plurality of interconnected tubes 35, each having a free end 36 thereof connected and communicating with the second aperture 11 of a different one of the fuel saving valves. In this example, the clearance volumes of the selected cylinders and the volume of the manifold collectively define, for descriptive purposes, the above mentioned reservoir volume. The illustrated tubes 35 have a relatively large internal passageway 37 to reduce fluid flow friction between the various cylinders.

For convenience, unless otherwise noted, like elements and parts are designated by the same reference numeral throughout the application.

The reference numeral 40 generally designates a second embodiment of the present invention and includes a closed tank 41 connected to and communicating with the second aperture 11 of the fuel saving valve assembly 1 through a tube 42. The tank 41 and tube 42 collectively comprise the reservoir volume disposed externally of the cylinder clearance volume 8, and are volumetrically sized in relation thereto to provide sufficient gases to flow into the cylinder clearance volume during a piston intake-downstroke position to severely reduce cylinder intake vacuum and resultant air fuel influx through the intake valve 30.

Figures 4, 5, 6, 7:
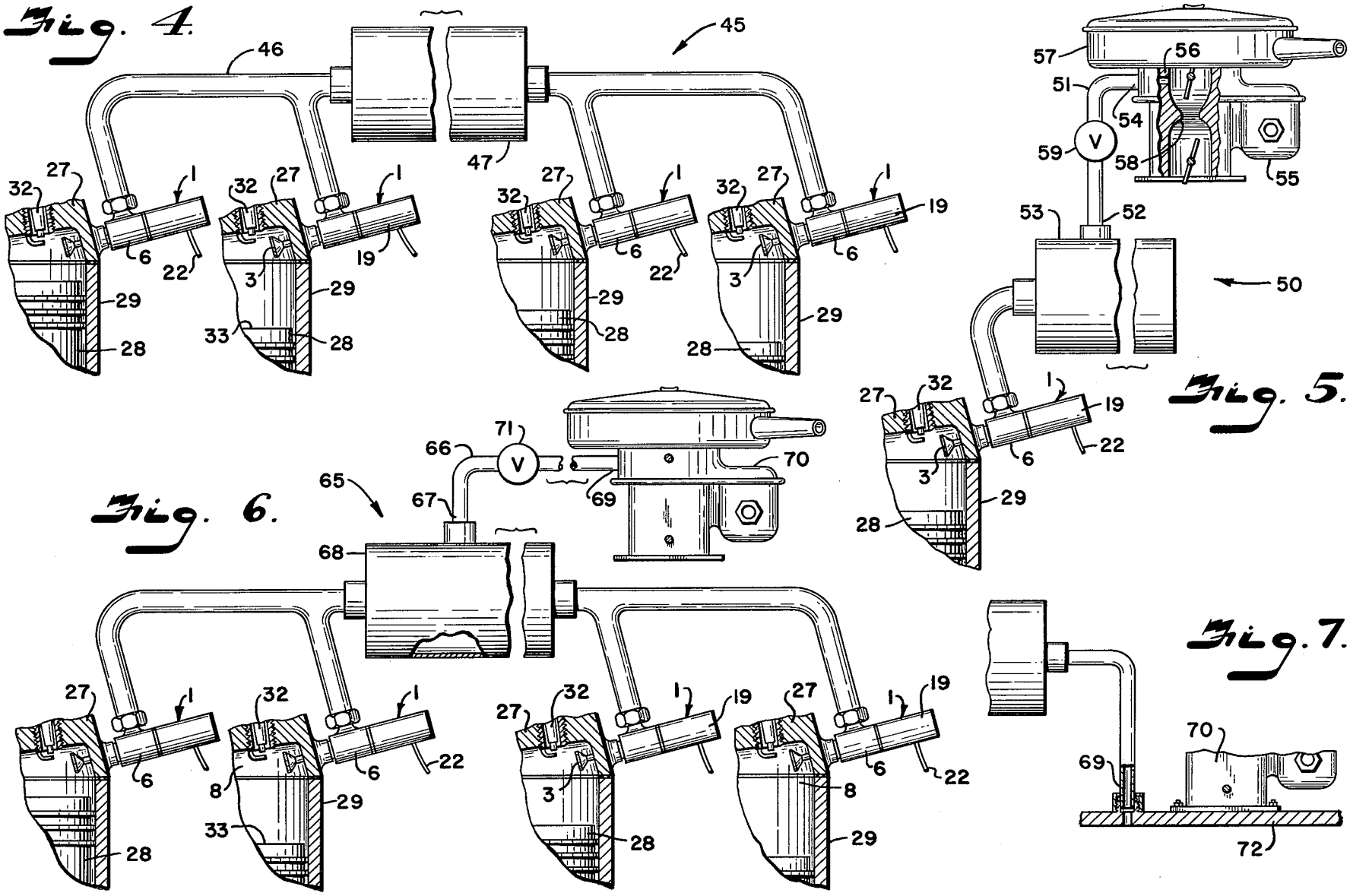
FIG. 4 is a partially schematic illustration of another embodiment of the present invention having a manifold and an interconnected tank.
FIG. 5 is a partially schematic illustration of another embodiment of the present invention wherein the tank communicates with an air intake portion of a carburetor.
FIG. 6 is a partially schematic illustration of another embodiment of the present invention wherein the tank and the manifold communicate with the air intake portion of the carburetor.
FIG. 7 is a partially schematic illustration of another embodiment of the present invention wherein the valve communicates with an engine intake manifold.

A third embodiment 45 of the present invention is illustrated in FIG. 4, and includes a manifold 46 and a closed surge tank 47 connected and communicating therewith. The manifold 46 is similar to the above described manifold 34, and the structure is sized in accordance with the previously discussed manner.

Another embodiment of the present invention is generally designated by the reference numeral 50 and is illustrated in FIG. 5. The arrangement is similar to the structure shown in FIG. 2 and includes a tube 51 having one end 52 connected with the tank 53 and the other end 54 connected with the engine carburetor 55. In the illustrated structure, the tube end 54 is attached to the carburetor at a point 56 disposed between the air intake filter 57 and the venturi 58. The tube 51 provides communication between the tank 53 and the upper portion 56 of the carburetor. In this example, a valve 59 is operably connected between the tank 53 and the carburetor 55 and selectively controls communication therebetween.

Another embodiment 65 of the present invention is illustrated in FIG. 6 and is similar to the structure shown in FIG. 4. A tube 66 has one end 67 thereof connected with a surge tank 68 and the other end 69 is connected with the upper portion of the carburetor 70. The illustrated structure includes a valve 71 operably connected between the surge tank 68 and the carburetor 70 for selectively controlling communication therebetween.

In use, each of the fuel saving valves 1 is closed for full engine power operation, such as during vehicle acceleration. When closed, the valve seals the cylinder's combustion chamber and enables the same to function in a normal manner. During predetermined low engine power demand periods, for example in the course of constant speed travel over substantially level expressways, the operator (or a suitable control device responding to operational conditions) opens the fuel saving valves for split engine operation. The vacuum normally created in the cylinder during the piston's downward intake stroke is severaly reduced as the cylinder draws in gases from the reservoir volume. Although the intake valve 30 is also in an open position during the intake stroke, only a minimal volume of air-fuel mixture is drawn therethrough. During the compression stroke, although both the intake and exhaust valves 30 and 31 are in a closed position, the gases within the cylinder are not appreciably compressed, but rather are simply displaced through the valve into the reservoir volume. Because these cylinder gases lack the proper fuel content and degree of compression, they will not burn when excited by the spark plug 32, thereby rendering ineffective the selected cylinders. Because the fuel saving valve is kept open during the compression stroke thereby preventing gas pressure build-up, the engine is capable of idling smoothly. The user (or control noted above) may, by deactivating the solenoid 19, close the selected valves and thereby immediately achieve full power operation for passing or demanding in-town driving.

In the structure illustrated in FIG. 2, instead of ambient air being drawn into the cylinder to break the vacuum normally created therein, gases from similarly equipped cylinders are drawn therein through the manifold 34. The pressure developed in a first cylinder clearance volume 8 during the upstroke position thereof forces gases into a second cylinder clearance volume during the downstroke position thereof, thereby breaking the vacuum normally produced therein. In this manner of exchanging gases between the various cylinders through a closed manifold system, there is less opportunity for foreign particles to enter and damage the cylinders, rings, bearings, and other internal parts.

In the structure illustrated in FIG. 3, gases are drawn from the tank 41 through the valve to break cylinder intake suction. As the piston reciprocates it pushes and draws the gases respectively into and from the tank 1 to form a closed system for clean, split engine operation. When dealing with internal combustion engines having multi-barrel carburetors, wherein each barrel communicates with a substantially separate passageway in the intake manifold and feeds a separate bank of cylinders, such as a V-8 engine with a four-barrel carburetor, the present invention contemplates an additional linkage on the accelerator valve (not shown), each valve being independently controllable for closing the barrel(s) associated with the deactivated bank of cylinders.

The arrangement illustrated in FIG. 4 operates in a similar manner to the structure shown in FIG. 2 and includes a surge tank 47 which assures sufficient gas flow to each of the selected cylinders during the intake stroke to break the vacuum normally created therein.

The arrangements shown in FIGS. 5 and 6 are similar to the structures illustrated in FIGS. 3 and 4 respectively, and include means for connecting the tank to an upper portion of the carburetor. A small volume of air fuel mixture may be drawn into the inoperative cylinders during the intake stroke. As a result, in order to achieve increased efficiency, these gases and/or vapors are transported to the carburetor intake for recycled use therein. The valve, 59 or 71 respectively, may be manipulated to close the system under suitable operating conditions, and may be opened to vent the tank and/or increase the size of the reservoir volume. As illustrated in FIG. 7, the outer end 69 of the tube 66 may be connected to and communicate with the engine intake manifold 72, providing care is exercised to avoid interference with the normal intake vacuum for the operating cylinders. This arrangement provides for quiet engine operation.

It is to be understood that while certain forms of this invention have been illustrated and described, it is not to be limited to the specific form or arrangement of parts herein described and shown, except insofar as such limitations are included in the following claims.

What is claimed and desired to secure by Letters Patent is:

1. In a multiple cylinder internal combustion engine including a carburetor and a plurality of cylinders each of which has a piston, said cylinders respectively forming a combustion chamber clearance volume above said respective pistons, and an intake and exhaust valve associated with said respective cylinders, the improvement of a device rendering temporarily ineffective selected engine cylinders during low engine power demand periods for reducing fuel consumption, said device comprising:

(a) an independently controlled fuel saving third valve member operably associated with at least one of the cylinders so as to provide communication between said clearance volume and a reservoir volume disposed externally thereof during the low engine demand periods;

(b) said third valve member, when open, severely reducing cylinder intake vacuum and resultant air-fuel influx to the extent that said one cylinder is rendered temporarily ineffective during the low engine demand periods, thereby reducing engine fuel consumption.

2. An improvement as set forth in claim 1 wherein:

(a) said fuel saving third valve constitutes a first fuel saving valve; including (b) a second fuel saving valve associated with a second of said cylinders and adapted to selectively provide communication between the clearance volume of said second cylinder and said reservoir volume; and wherein (c) said reservoir volume is defined by a closed manifold operably connecting said first and second fuel saving valves and providing communication between the clearance volumes of said first and second cylinders when said fuel saving values are in an open position, whereby pressure in said one cylinder clearance volume during an upstroke position thereof forces gases into said second cylinder clearance volume during a downstroke position thereof and severely reduces the cylinder intake and resultant air-fuel influx to said second cylinder thereby rendering the same temporarily ineffective.

3. An improvement as set forth in claim 1 wherein:

(a) said reservoir volume is defined by a closed tank connected and communicating with said fuel saving third valve.

4. An improvement as set forth in claim 2 wherein:

(a) said manifold includes a closed surge tank connected and communicating with said manifold.

5. An improvement as set forth in claim 3 wherein:

(a) said tank communicates with said carburetor whereby exhaust from said fuel saving third valve is introduced into said carburetor.

6. An improvement as set forth in claim 4 wherein:

(a) said surge tank communicates with said carburetor whereby exhaust from said fuel saving third valve is introduced into said carburetor.

7. An improvement as set forth in claim 5 including:

(a) a valve operably connected between said tank and said carburetor, and selectively controlling communication therebetween.

8. An improvement as set forth in claim 6 including:

(a) a valve operably connected between said surge tank and said carburetor, and selectively controlling communication therebetween.

9. An improvement as set forth in claim 2 wherein said manifold comprises:

(a) a plurality of interconnected tubes each having a free end thereof associated and communicating with a different one of said fuel saving valves.

10. An improvement as set forth in claim 1 wherein:

(a) said internal combustion engine includes an intake manifold; and (b) said fuel saving third valve is connected to and communicates with said engine intake manifold.

* * * * *